US006040510A

United States Patent [19]

Yaun

[11] Patent Number: 6,040,510

[45] Date of Patent: Mar. 21, 2000

[54] ACOUSTIC STRINGED INSTRUMENT ENHANCEMENT DEVICE

[76] Inventor: James S. Yaun, 115 Captain Lowman Rd., Chapin, S.C. 29036

[21] Appl. No.: 09/039,183

[22] Filed: Mar. 16, 1998

Related U.S. Application Data

[60] Provisional application No. 60/046,305, May 13, 1997.

[51] Int. Cl.[7] ..... G10D 3/02

[52] U.S. Cl. ..... 84/294; 84/295

[58] Field of Search ..... 84/294, 295, 290, 84/267, 269, 270, 274, 276, 277

[56] References Cited

U.S. PATENT DOCUMENTS

| | | | |
|---|---|---|---|
| 66,347 | 7/1867 | Hulskamp | 84/275 |
| 231,084 | 8/1880 | Peaker | 84/295 |
| 493,875 | 3/1893 | Quinlan | 84/269 |
| 685,920 | 11/1901 | Heck | 84/294 |
| 1,513,159 | 10/1924 | Cremer | 84/295 |
| 1,539,961 | 6/1925 | Scott | 84/295 |
| 1,560,372 | 11/1925 | Berge | 84/269 |
| 1,588,730 | 6/1926 | Hessel | 84/294 |
| 2,145,237 | 1/1939 | Eberhart | 84/277 |
| 2,473,980 | 6/1949 | Willner | 84/295 |
| 3,623,390 | 11/1971 | Pitt, Jr. | 84/294 |
| 3,690,210 | 9/1972 | Imai et al. | 84/267 |
| 4,762,046 | 8/1988 | Aspri et al. | 84/294 |
| 4,984,493 | 1/1991 | Schaller | 84/313 |
| 5,567,895 | 10/1996 | Aspri et al. | 84/294 |
| 5,567,896 | 10/1996 | Gottschall | 84/294 |
| 5,581,043 | 12/1996 | Bowar | 84/291 |
| 5,739,444 | 4/1998 | Borisoff | 84/291 |

FOREIGN PATENT DOCUMENTS

| | | |
|---|---|---|
| 538717 | 6/1922 | France . |
| 357025 | 7/1921 | Germany . |
| 351046 | 3/1922 | Germany . |
| 548930 | 1/1931 | Germany . |
| 2818618 | 11/1979 | Germany . |
| 5713 | of 1887 | United Kingdom . |
| 256157 | 8/1926 | United Kingdom . |

OTHER PUBLICATIONS

"Vital Statistics," pamphlet published for the Chicago Trade Show, Jul. 1958.

*Primary Examiner*—Robert E. Nappi
*Assistant Examiner*—Kim Lockett
*Attorney, Agent, or Firm*—Richard C. Litman

[57] ABSTRACT

An internal, acoustic enhancement device attached to a standard, conventional stringed musical instrument without causing damage thereto. The internal acoustic enhancement device includes two or four tensioned springs disposed in a V-shaped or X-shaped configuration removably attached to vibration blocks secured within the soundbox of the stringed musical instrument.

13 Claims, 6 Drawing Sheets

ACOUSTIC STRINGED INSTRUMENT ENHANCEMENT DEVICE

CROSS-REFERENCE TO RELATED APPLICATION

This application claims the benefit of U.S. Provisional Patent Application Ser. No. 60/046,305, filed May 13, 1997.

BACKGROUND OF THE INVENTION

1. Field of the Invention

The present invention relates to a stringed musical instrument such as an acoustic guitar, a mandolin, a violin, etc., and more particularly to an acoustic enhancement device which enhances the amplification, sustain, and reverberation of the sounds generated by plucking, striking or otherwise vibrating the instrument strings.

2. Description of Related Art

It is well known that the resonance of a stringed musical instrument sound box can be enhanced by incorporating within or above the sound box, a plurality of springs, coils or strings which can respond to the vibrations of the primary strings. These sound box springs amplify and sustain the resonant effect of the sounds generated by plucking, striking or otherwise vibrating the instrument strings. Those acoustic enhancement devices which are attached to the outside of the instrument can alter the balance of the instrument, interfere with a performer's playing, and be visually distracting. Therefore, it is preferable if the acoustic enhancement device is disposed within the soundbox of the instrument.

Those existing acoustic enhancement devices which are interiorly disposed are generally designed according to one of two arrangements. In one arrangement, the springs are stretched across the entire interior of the sound box longitudinally from the neck end to the shoulder strap attachment end, substantially parallel to the instrument strings. Due to their length, the springs are able to pick up a substantial portion of the vibrations present within the soundbox. Also, due to being stretched across the longitudinal centerline of the soundbox, the resonating springs more effectively re-emit sound out of the soundbox through the sound hole.

In the second arrangement, one end of the springs is connected to the inside top surface of the sound box, directly under the bridge, and the other end of the springs is connected to the neck end of the soundbox. The springs in this latter arrangement do not pick up the vibrations from the interior of the soundbox as well as in the former arrangement because the springs of the latter arrangement are shorter and span a smaller portion of the soundbox. However, by being connected to the soundbox directly under the bridge, the springs more effectively pick up vibrations from the bridge. The springs in this arrangement are also stretched across the longitudinal centerline of the soundbox, so they too effectively re-emit sound out of the soundbox through the sound hole.

The related art is represented by the following patents of interest.

U.S. Pat. No. 231,084, issued on Aug. 10, 1880 to Thomas Peaker, describes a violin with two or more adjustable strings or iron bars inside the body stretched from one end of the body to the other. Peaker does not suggest an acoustic stringed instrument enhancement device according to the claimed invention.

U.S. Pat. No. 685,920, issued on Nov. 5, 1901 to August Heck, describes a stringed musical instrument with an adjustable resonator inside the body stretched from one end of the body to the other. Heck does not suggest an acoustic stringed instrument enhancement device according to the claimed invention.

U.S. Pat. No. 1,588,730, issued on Jun. 15, 1926 to Isidor Hessel, describes a resonator device for violins. Hessel does not suggest an acoustic stringed instrument enhancement device according to the claimed invention.

U.S. Pat. No. 3,623,390, issued on Nov. 30, 1971 to Jack R. Pitt, Jr., describes an adaptor for stringed musical instruments comprising a plurality of parallel vibrating members rotatably mounted to a base at one end and disposed transverse to the strings of a stringed musical instrument so that a head at the other end of each of the vibrating members is positioned to engage a string of the stringed instrument. Pitts, Jr. does not suggest an acoustic stringed instrument enhancement device according to the claimed invention.

U.S. Pat. No. 4,762,046, issued on Aug. 9, 1988 to Roberto Aspri et al., describes a sound reverberator device for detachable connection to the strings of a string musical instrument. Aspri et al. '046 does not suggest an acoustic stringed instrument enhancement device according to the claimed invention.

U.S. Pat. No. 4,984,493, issued on Jan. 15, 1991 to Helmut F. K. Schaller, describes a mechanism for applying an adjustable counter-tension to the spring anchor of a tremolo device used with a guitar or similar stringed musical instrument. Schaller does not suggest an acoustic stringed instrument enhancement device according to the claimed invention.

U.S. Pat. No. 5,567,895, issued on Oct. 22, 1996 to Roberto Aspri et al., describes a sound reverberator of a string musical instrument comprising one or more pre-tensioned metal springs secured internally of the sound box. Aspri et al. '895 does not suggest an acoustic stringed instrument enhancement device according to the claimed invention.

U.S. Pat. No. 5,567,896, issued on Oct. 22, 1996 to Peter Gottschall, describes a string musical instrument having an intermediate plate mounted in the interior of the sound box at a predetermined inclination to provide sound amplification. Gottschall does not suggest an acoustic stringed instrument enhancement device according to the claimed invention.

U.S. Pat. No. 5,581,043, issued on Dec. 3, 1996 to Richard D. Bowar, describes a stringed musical instrument with adjustable baffles within the sound box that enable the user to change or adjust the wavelength of the music produced by the instrument to more closely coincide with the overtone transmission capability of the ambient environment. Bowar does not suggest an acoustic stringed instrument enhancement device according to the claimed invention.

German Patent document 351,046, published on Mar. 30, 1922, describes a tone enhancer device for a stringed musical instrument. German '046 does not suggest an acoustic stringed instrument enhancement device according to the claimed invention.

German Patent document 2,818,168, published on Nov. 8, 1979, describes an undesirable resonance damper for stringed musical instruments. German '168 does not suggest an acoustic stringed instrument enhancement device according to the claimed invention.

Great Britain Patent document 256,157, published on Aug. 5, 1926, describes a resonator device for violins. Great Britain '157 does not suggest an acoustic stringed instrument enhancement device according to the claimed invention.

These devices all suffer from multiple deficiencies. Foremost, the existing devices are designed to be permanently built into the instrument at the time of the instrument's construction. Hence, most acoustic enhancement devices cannot be attached to previously constructed, standard store-bought guitars. Those devices that can be later attached, require that the soundbox be disassemble and reglued, or that additional holes be drilled into the soundbox, in order to incorporate the acoustic enhancement device thereinto. Thus, even if later retrofitting is theoretically feasible, such an acoustic enhancement device would not be desirable because the standard musician does not have the proper tools nor skill to properly disassemble and reassemble his or her instrument. Further, even if skill, tools and cost are not considerations, a musician would be reticent to make such major structural alterations because of the risk that it could detrimentally alter the instrument's acoustics.

Another deficiency with existing acoustic enhancement devices is that most can not be selectively engaged or disengaged, as desired by the musician. U.S. Pat. No. 5,567,895 issued to Aspri et al. does disclose a pre-tensioned interior spring which can be engaged or disengaged selectively. However, to accomplish this selective-engagement function, the Aspri et al. '895 invention incorporates a complex mechanism for into the guitar design which requires extra holes be drilled into the soundbox. The device is not intended for use by attachment to a standard store-bought guitar. Therefore, a need exists for an unobtrusive, adjustment-free, stringed instrument acoustic enhancement device which can be removably placed within the soundbox of a standard, conventional stringed instrument without causing damage thereto.

None of the above inventions and patents, taken either singly or in combination, is seen to describe the instant invention as claimed.

SUMMARY OF THE INVENTION

The internal acoustic enhancement device of the present invention enhances the amplification, sustain, and reverberation of the sounds generated by plucking, striking or otherwise vibrating the strings of a stringed musical instrument. The internal acoustic enhancement device can be attached to a standard, conventional stringed acoustic instrument without causing damage thereto. This goal is achieved by attaching tensioned springs to hooks which are disposed within the soundbox of the stringed musical instrument. The hooks are disposed within the soundbox without damaging the instrument by screwing the hooks into a vibration transmitting material, such as a block of wood. The wood blocks are then, in turn, affixed to the soundbox, by conventional means such as epoxy glue.

A basic configuration of a stringed musical instrument has a body consisting of an upper sounding board, a lower sounding board, sides, and a neck which ends on a head. A bridge base is secured to the upper sounding board. Strings are stretched from the head where they are fastened to tuning machines. The strings are tensioned between the tuning machines and the bridge base where they pass over a saddle. The upper sounding board also includes a sound hole that extends through the top of the upper sounding board between the neck and the bridge. Upraised metal ridges called frets are located at designated intervals on the neck perpendicular to the strings.

The first embodiment of the stringed instrument acoustic enhancement device comprises the following components. A vibration transmitting block, such as a block of wood, is affixed to the inside top surface of the upper sounding board directly under and substantially parallel to the saddle by conventional means such as epoxy glue. Two conventional eye hooks are screwed into the vibration transmitting block. One of the two block eye hooks is screwed into the vibration transmitting block below the three lower pitched guitar strings, and the other block eye hook is screwed into the vibration transmitting block below the three higher pitched guitar strings.

Two opposedly spaced bottom blocks are affixed to the inside bottom surface at the neck end of the soundbox by conventional means such as epoxy glue. One conventional eye hook is screwed into each of the bottom blocks. Two springs are tensionally disposed within the soundbox in a V-shape configuration. The first spring has an upper end removably attached to the first block eye hook, and has a lower end removably attached to the one of the two bottom blocks which is disposed adjacent to string. The second spring has an upper end removably attached to the second block eye hook, and has a lower end removably attached to the one of the two bottom blocks which is disposed adjacent to string.

The second embodiment of the stringed instrument acoustic enhancement device comprises the following components. A vibration transmitting block, such as a block of wood, is affixed to the inside top surface of the upper sounding board directly under and substantially parallel to the saddle by conventional means such as epoxy glue. Four conventional eye hooks are screwed into the vibration transmitting block. Two of the four eye hooks are screwed into the vibration transmitting block below the three lower pitched strings, and the other two eye hooks are screwed into the vibration transmitting block below the three higher pitched guitar strings.

Two opposedly spaced bottom blocks are affixed to the inside bottom surface at the neck end of the soundbox by conventional means such as epoxy glue. One conventional eye hook is screwed into each of the bottom blocks. First and third springs are tensionally disposed within the soundbox in a V-shape configuration. The first spring has an upper end removably attached to the first block eye hook, and has a lower end removably attached to the one of the two bottom blocks which is disposed adjacent to string. The third spring has an upper end removably attached to the second block eye hook, and has a lower end removably attached to the one of the two bottom blocks which is disposed adjacent to string.

Two opposedly spaced bottom blocks are affixed to the inside bottom surface of the lower sounding board at the shoulder strap attachment end by conventional means such as epoxy glue. One conventional eye hook is screwed into each of the bottom blocks. Second and fourth springs are tensionally disposed within the soundbox in a V-shape configuration. The second spring has an upper end removably attached to the first block eye hook, and has a lower end removably attached to the one of the two bottom blocks which is disposed adjacent to string. The fourth spring has an upper end removably attached to the second block eye hook, and has a lower end removably attached to the one of the two bottom blocks which is disposed adjacent to string. The four springs are resultantly configured in the soundbox in an X-shape configuration.

Accordingly, it is a principal object of the invention to provide a stringed instrument acoustic enhancement device which enhances the amplification, sustain, and reverberation of the sounds generated by plucking, striking or otherwise vibrating the strings of a stringed musical instrument.

It is another object of the invention is to provide a stringed instrument acoustic enhancement device which can be placed within the soundbox of a conventional stringed musical instrument.

It is another object of the invention to provide a stringed instrument acoustic enhancement device which can be placed within the soundbox of a stringed musical instrument without cutting, drilling, or scratching the instrument.

It is a further object of the invention to provide a stringed instrument acoustic enhancement device which does not need adjustment.

It is a further object of the invention to provide a stringed instrument acoustic enhancement device which is removable for optional playing of the instrument without acoustic enhancement.

It is still a further object of the invention to provide an unobtrusive stringed instrument acoustic enhancement device which does not interfere with a performer's playing of the instrument.

It is an object of the invention to provide improved elements and arrangements thereof in a stringed instrument acoustic enhancement device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
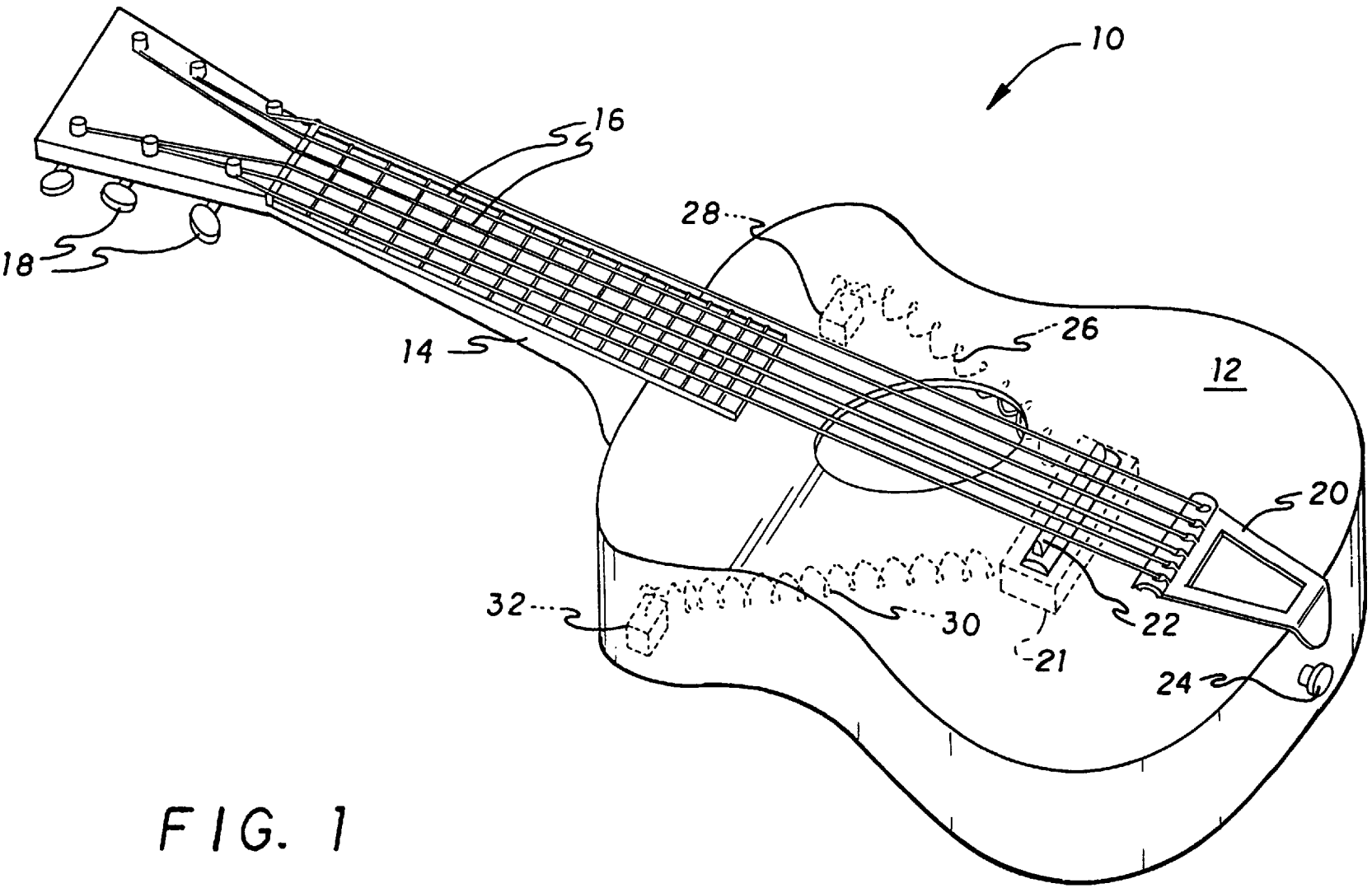
FIG. 1 is an environmental perspective view of a conventional guitar with a first embodiment of the acoustic enhancement device according to the present invention depicted in phantom lines within the guitar soundbox.
Figure 2:
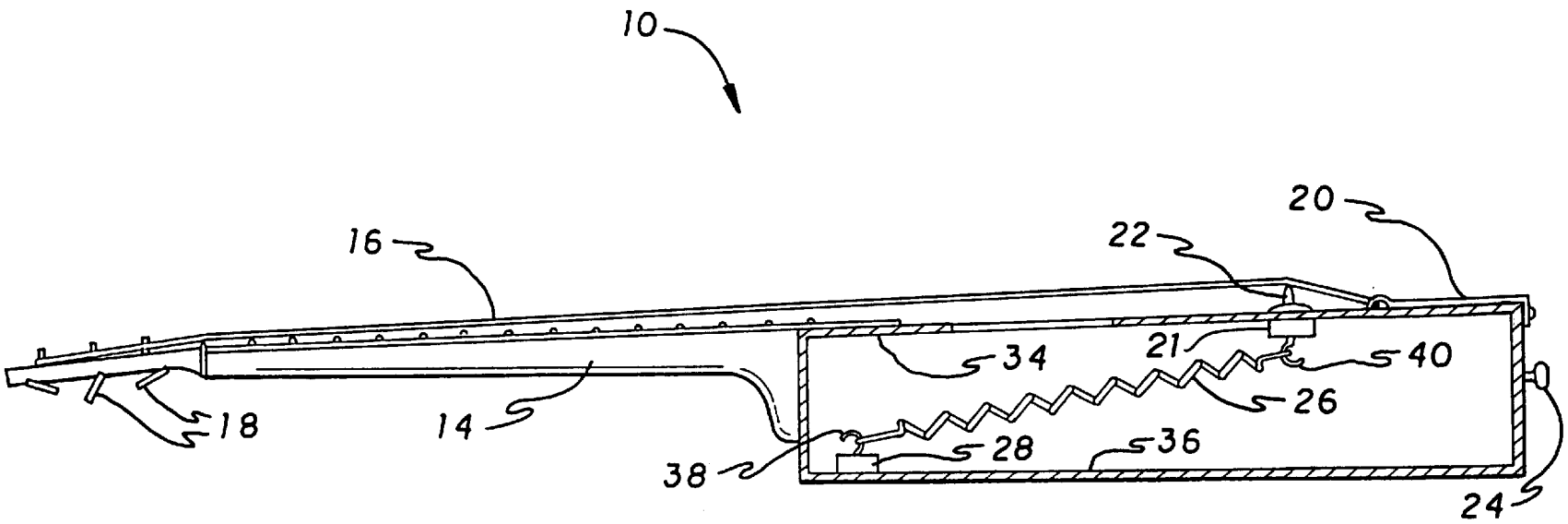
FIG. 2 is a side view of a conventional guitar including a cutaway side view of the first embodiment of the invention disposed within the soundbox.
Figure 3:
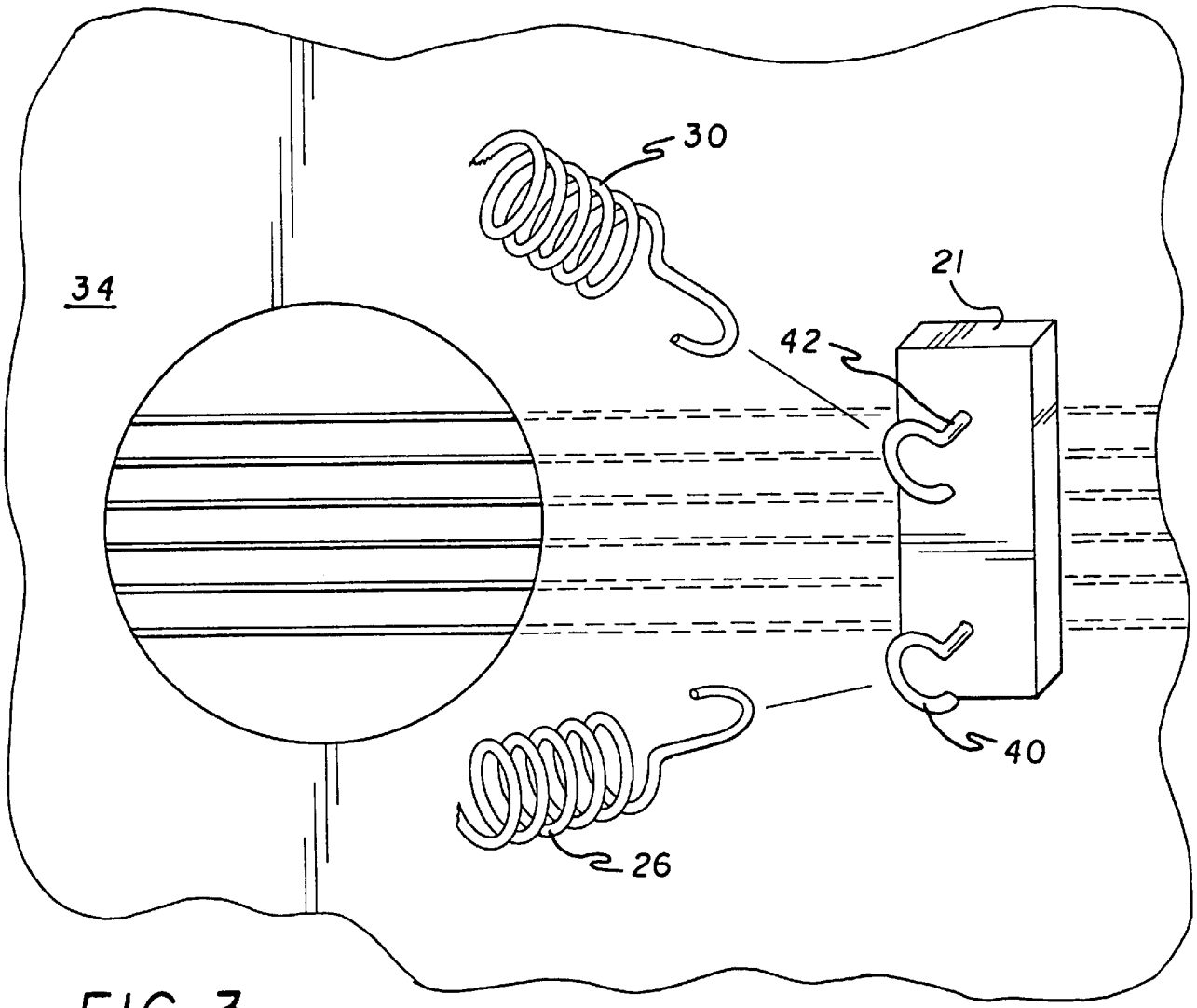
FIG. 3 is a fragmented bottom view of the inside surface of the soundbox top wall of the guitar shown in FIGS. 1 and 2 showing a bridge block according to the present invention attached thereto and an exploded fragment view of the first embodiment of the soundbox springs.

Referring to the drawings, and more particularly to FIGS. 1–3, there is shown generally a basic configuration of a conventional acoustic guitar 10, as an example of a stringed musical instrument, provided with a first embodiment of an internal acoustic sound enhancement device according to the present invention that enhances the amplification, sustain, and reverberation of the sounds generated by plucking, striking or otherwise vibrating the instrument strings. The guitar 10 has a body consisting of an upper sounding board 12, a lower sounding board, sides, and a neck 14 which ends on a head. The upper sounding board 12 and the lower sounding board each have a neck end and a shoulder strap attachment end. A bridge base 20 is secured to the upper sounding board 12. A shoulder strap attachment 24 is affixed to a side disposed between the shoulder strap attachment end of the upper sounding board 12 and the lower sounding board. Strings generally designated 16, including bass strings and treble strings, are stretched from the head where they are fastened to tuning machines 18. The strings 16 may be steel, gut or any type string ordinarily used with an acoustic guitar. The strings 16 are tensioned between the turning machines 18 and the bridge base 20 where they pass over saddle 22. The upper sounding board 12 also includes a sound hole that extends through the top of the upper sounding board 12 between the neck 14 and the saddle 22. Upraised metal ridges called frets are located at designated intervals on the neck 14 perpendicular to the strings.

The first embodiment of the stringed instrument acoustic enhancement device comprises the following components. A vibration transmitting block 21 such as a block of wood, is affixed to the inside top surface 34 of the upper sounding board 12 directly under and substantially parallel to the saddle 22 by conventional means such as epoxy glue. The vibration transmitting block 21 is then, in turn, affixed to the upper sounding board 12. Two conventional eye hooks 40 and 42 are screwed into the vibration transmitting block 21. The first of the two block eye hooks 40 is screwed into the vibration transmitting block 21 below the three lower pitched guitar strings, and the second bridge block eye hook 42 is screwed into the vibration transmitting block 21 below the three higher pitched guitar strings.

Two opposedly spaced bottom blocks 28 and 32 are affixed to the inside bottom surface 36 of the lower sounding board at the neck end by conventional means such as epoxy glue. One conventional eye hook is screwed into each of the bottom blocks 28 and 32. Two springs 26 and 30 are tensionally disposed within the soundbox. The first spring 26 has an upper end removably attached to a block eye hook 40, and has a lower end removably attached to a bottom block 28. The second spring 30 has an upper end removably attached to a block eye hook 42, and has a lower end removably attached to a bottom block 32. It is preferable if the first spring 26 is thinner than second spring 30 for improved resonance of both high and low notes. It is particularly preferable if the thinner spring 26 of the two springs 26,30 is disposed within the soundbox below the higher pitched strings and the thicker spring 30 is disposed below the lower pitched strings. Optimally, the thinner spring 26 should be approximately ¼ inch thick, and the thicker spring 30 should be approximately ½ inch thick.

Figure 4:
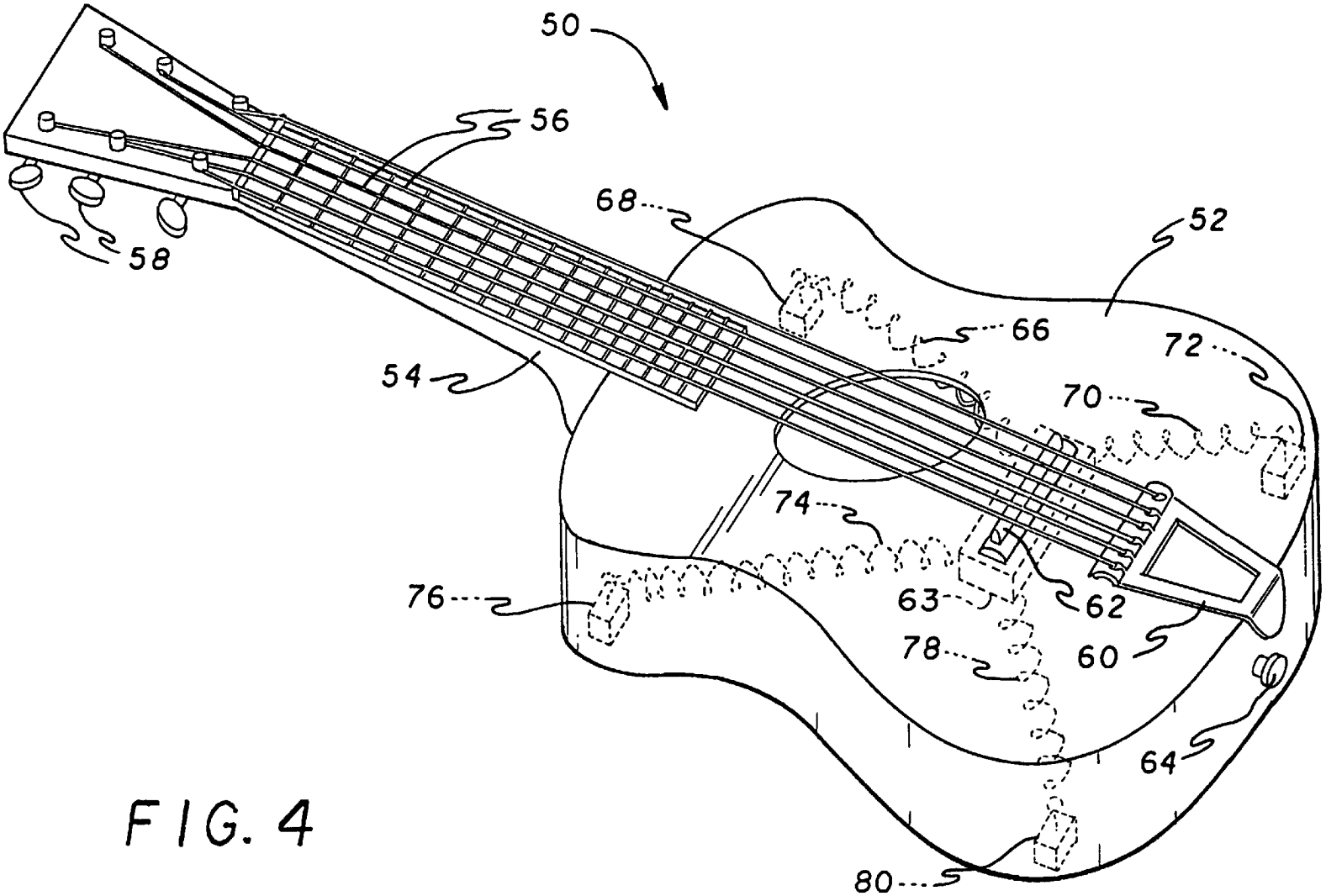
FIG. 4 is an environmental perspective view of a conventional guitar with a second embodiment of the acoustic enhancement device according to the present invention depicted in phantom lines within the guitar soundbox.
Figure 5:
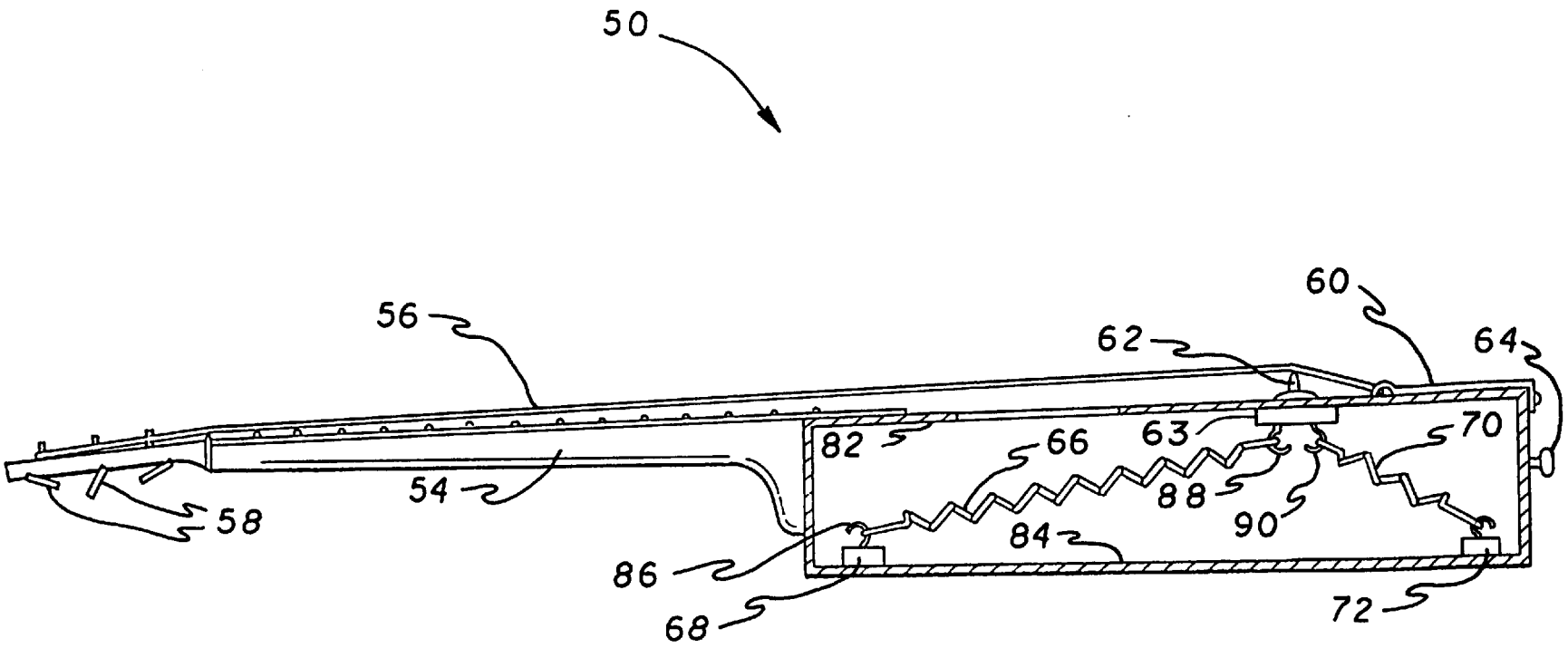
FIG. 5 is a side view of a conventional guitar including a cutaway side view of the second embodiment of the invention disposed within the soundbox.
Figure 6:
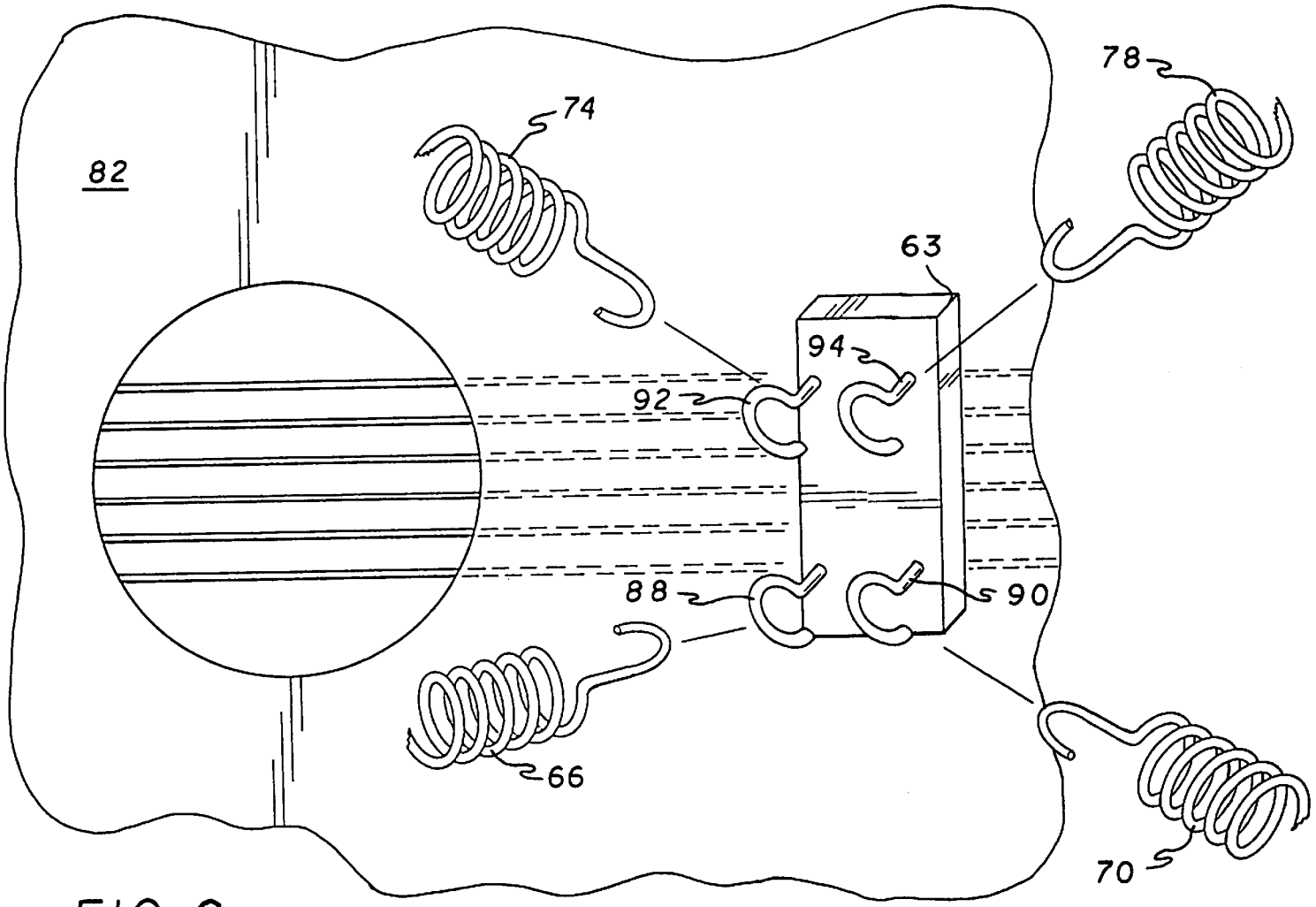
FIG. 6 is a fragmented bottom view of the inside surface of the soundbox top wall of the guitar shown in FIGS. 4 and 5 showing a bridge block according to the present invention attached thereto and an exploded fragment view of the second embodiment of the soundbox springs.

A conventional acoustic guitar 50 provided with a second embodiment of an internal acoustic sound enhancement device according to the present invention is illustrated in FIGS. 4–6. The guitar 50 has a body consisting of an upper sounding board 52, a lower sounding board, sides, and a neck 54 which ends on a head. The upper sounding board 52 and the lower sounding board each have a neck end and a shoulder strap attachment end. A bridge base 60 is secured to the upper sounding board 52. A shoulder strap attachment 64 is affixed to a side disposed between the shoulder strap attachment end of the upper sounding board 12 and the lower sounding board. Strings generally designated 56, including bass strings and treble strings, are stretched from the head where they are fastened to tuning machines 58. The strings 56 may be steel, gut or any type string ordinarily used with an acoustic guitar. The strings 56 are tensioned between the turning machines 58 and the bridge base 60 where they pass over saddle 62. The upper sounding board 52 also includes a sound hole that extends through the top of the upper sounding board 52 between the neck 54 and the saddle 62. Upraised metal ridges called frets are located at designated intervals on the neck 54 perpendicular to the strings.

The second embodiment of the stringed instrument acoustic enhancement device comprises the following components. A vibration transmitting block 63, such as a block of wood, is affixed to the inside top surface 82 of the upper sounding board 52 directly under and substantially parallel to the saddle 62 by conventional means such as epoxy glue. The vibration transmitting block 63 is then, in turn, affixed to the upper sounding board 52. Four conventional eye hooks 88,90,92,94 are screwed into the vibration transmitting block 63. The block eye hooks 88 and 90 are screwed into the vibration transmitting block 63 below the three lower pitched guitar strings, and the block eye hooks 92 and 94 are screwed into the vibration transmitting block 63 below the three higher pitched guitar strings.

Two opposedly spaced bottom blocks 68,76 are affixed to the inside bottom surface 84 at the neck end of the lower sounding board by conventional means such as epoxy glue. One conventional eye hook is screwed into each of the bottom blocks 68,76. First and third springs 66,70 are tensionally disposed within the soundbox in a V-shape configuration. The first spring 66 has an upper end removably attached to block eye hook 86, and has a lower end removably attached to a bottom block 68. The third spring 74 has an upper end removably attached to the block eye hook 92, and has a lower end removably attached to a bottom block 76.

Two opposedly spaced bottom blocks 72,80 are affixed to the inside bottom surface 82 of the lower sounding board at the shoulder strap attachment end by conventional means such as epoxy glue. One conventional eye hook is screwed into each of the bottom blocks 72,80. Second and fourth springs 74,78 are tensionally disposed within the soundbox. The second spring 74 has an upper end removably attached to a block eye hook 90, and has a lower end removably attached to a bottom block 72. The fourth spring 78 has an upper end removably attached to a block eye hook 94, and has a lower end removably attached to a bottom block 80. The four springs 66,70,74,78 are resultantly configured in the soundbox in an X-shape configuration. It is preferable if second and fourth springs 74,78 are thinner than first and third springs 66,70 for improved resonance of both high and low notes. It is particularly preferable if the thinner springs 74,78 of the four springs are disposed within the soundbox below the higher pitched strings and the thicker springs 66,70 are disposed below the lower pitched strings. Optimally, the thinner springs should be approximately ¼ inch thick, and the thicker springs should be approximately ½ inch thick.

This invention is an improvement for several reasons. First, open ends can be provided on either the springs, the hooks, or both. The attached springs would thereby be selectively detachable, providing the musician with the option of playing the instrument with or without the acoustic enhancement device.

A second improvement relates to the positioning of the tensioned springs. No patents for acoustic enhancement devices disclose angling the lower ends of the springs outward in a V-shapes or X-shape configuration. A V-shape or X-shape configuration is preferable because it enables longer springs to be extended into the outcurving contours of the soundbox. This configuration is an improvement because it combines the benefit of attaching the springs directly underneath the bridge with the additional benefit of utilizing springs which are longer than could be used if the springs extended from the bridge, parallel under the strings. Also, because the upper ends of the springs are positioned close together at the longitudinal centerline of the guitar, the springs still pass in close proximity to the sound hole. In combination, these three factors increase the vibrations picked up by the springs and retransmitted out of sound hole. Thus, this configuration enhances the acoustic resonance beyond that attained by the current art and particularly brings out the 12th harmonic of the strings.

Thirdly, the individual pieces of the device may be sold together in a kit. The kit could additionally include directions, a template, or both, thereby facilitating the user in positioning the vibration transmitting blocks within the sound box. Alternatively, because the vibration transmitting blocks are attached to the sound block independently of each other, the user may adjust the placement of the blocks according to the user's individual preference.

It is to be understood that the present invention is not limited to the sole embodiment described above, but encompasses any and all embodiments within the scope of the following claims.

I claim:

1. In combination: an acoustic stringed instrument enhancement device and a stringed instrument, the stringed instrument including a soundbox having a neck end, a shoulder strap attachment end, an upper sounding board having an inner surface, a lower sounding board having an inner surface, a bridge and a saddle disposed upon the upper sounding board, a sound hole extending through the upper sounding board, and a plurality of strings stretched over the saddle and above the sound hole, and said acoustic enhancement device comprising:

a vibration transmitting block affixed to the inner surface of the upper sounding board directly under and substantially parallel to the saddle;

two bottom blocks affixed in spaced opposition on the inner surface of the lower sounding board at the neck end of the soundbox;

a first tensioned spring having an upper end removably attached to said vibration transmitting block, and having a lower end removably attached to one of said bottom blocks;

a second tensioned spring having an upper end removably attached to said vibration transmitting block, and having a lower end removably attached to the other of said bottom blocks; and, wherein the two tensioned springs are disposed within the soundbox in a V-shaped configuration.

2. The combination according to claim 1, wherein each of said blocks are glued to the soundbox.

3. The combination according to claim 1, wherein eye screws are screwed into each of said vibration transmitting and bottom blocks for attaching said ends of said tensioned spring to said vibration transmitting and bottom blocks.

4. The combination according to claim 1, wherein said first spring is disposed below three lower pitched strings and said second spring is disposed below three higher pitched strings.

5. The combination according to claim 4, wherein said first spring disposed below three lower pitched strings is thicker than said second spring disposed below three higher pitched strings.

6. The combination according to claim 4, wherein said first spring disposed below the three lower pitched strings is approximately ½ inch thick and said second spring disposed below the three higher pitched strings is approximately ¼ inch thick.

7. In combination: an acoustic stringed instrument enhancement device and a stringed instrument, the stringed instrument including a soundbox having a neck end, a shoulder strap attachment end, an upper sounding board having an inner surface, a lower sounding board having an inner surface, a bridge and a saddle disposed upon the upper sounding board, a sound hole extending through the upper sounding board, and a plurality of strings stretched over the saddle and above the sound hole, and said acoustic enhancement device comprising:

a vibration transmitting block affixed to the inner surface of said upper sounding board directly under and substantially parallel to the saddle;

two bottom blocks affixed in spaced opposition on the inner surface of the lower sounding board at the neck end of the soundbox;

two bottom blocks affixed in spaced opposition on the inner surface of the lower sounding board at the shoulder strap attachment end of the soundbox;

a first tensioned spring having an upper end removably attached to said vibration transmitting block, and having a lower end removably attached to one of said bottom blocks affixed in spaced opposition on the inner surface of the lower sounding board at the neck end of the soundbox;

a second tensioned spring having an upper end removably attached to said vibration transmitting block, and having a lower end removably attached to the other of said bottom blocks affixed in spaced opposition on the inner surface of the lower soundings board at the neck end of soundbox;

a third tensioned spring having an upper end removably attached to said vibration transmitting block, and having a lower end removably attached to one of said bottom blocks affixed in spaced opposition on the inner surface of the lower sounding board at the shoulder strap attachment end of the soundbox;

a fourth tensioned spring having an upper end removably attached to said vibration transmitting block, and having a lower end removably attached to the other of said bottom blocks affixed in spaced opposition on the inner surface of the lower sounding board at the shoulder strap attachment end of the soundbox; and, wherein said first, second, third and fourth tensioned springs are disposed within the soundbox in an X-shaped configuration.

8. The combination according to claim 7, wherein each of said blocks are glued to the soundbox.

9. The combination according to claim 7, wherein eye screws are screwed into each of said blocks for attaching said ends of said tensioned springs to said blocks.

10. The combination according to claim 7, wherein said first spring and said third spring are disposed below three lower pitched strings and said second spring and said fourth spring are disposed below three higher pitched strings.

11. The combination according to claim 10, wherein said first spring and said third spring disposed below three lower pitched strings are each thicker than said second spring and said fourth spring disposed below three higher pitched strings.

12. The combination according to claim 10, wherein said first spring and said third spring disposed below the three lower pitched strings are each approximately ½ inch thick and said second spring and said fourth spring disposed below the three higher pitched strings are each approximately ¼ inch thick.

13. In combination: an acoustic stringed instrument enhancement device and a stringed instrument, the stringed instrument including a soundbox having a neck end, a shoulder strap attachment end, an upper sounding board having an inner surface, a lower sounding board having an inner surface, a bridge and a saddle disposed upon the upper sounding board, a sound hole extending through the upper sounding board, and a plurality of strings stretched over the saddle and above the sound hole, and said acoustic enhancement device comprising:

a vibration transmitting block affixed to the inner surface of the upper sounding board directly under and substantially parallel to the saddle;

two bottom blocks affixed in spaced opposition on the inner surface of the lower sounding board at the neck end of the soundbox;

a first tensioned spring having an upper end removably attached to said vibration transmitting block, and having a lower end removably attached to one of said bottom blocks;

a second tensioned spring having an upper end removably attached to said vibration transmitting block, and having a lower end removably attached to the other of said bottom blocks; and, wherein said first and second tensioned springs are disposed within the soundbox in a V-shaped configuration, said first tensioned spring being disposed below three lower pitched strings and said second tensioned spring being disposed below three higher pitched springs.

* * * * *